United States Patent [19]

Lopes

[11] 4,294,053

[45] Oct. 13, 1981

[54] MOBILE HOME ANCHOR

[76] Inventor: Rosario Lopes, 19266 Berden, Harper Woods, Mich. 48225

[21] Appl. No.: 912,321

[22] Filed: Jun. 5, 1978

[51] Int. Cl.[3] ..... E02D 27/00

[52] U.S. Cl. ..... 52/295; 52/23; 403/154

[58] Field of Search ..... 52/23, 295, DIG. 11; 403/154, 150, 151, 49, 379; 24/201 LP, 116 R, 73 TL, 73 PP, 73 CS, 73 CE; 248/361 R

[56] References Cited

U.S. PATENT DOCUMENTS

| | | | |
|---|---|---|---|
| 2,798 | 11/1867 | Wanzer | 403/154 |
| 3,520,224 | 7/1970 | Hensley | 403/379 |
| 3,724,151 | 4/1973 | Kaywood | 52/DIG. 11 |
| 3,828,491 | 8/1974 | Koon | 52/DIG. 11 |
| 4,064,668 | 12/1977 | Carter | 52/295 |

FOREIGN PATENT DOCUMENTS

| | | | |
|---|---|---|---|
| 149300 | 3/1904 | Fed. Rep. of Germany | 403/154 |

*Primary Examiner*—Price C. Faw, Jr.
*Assistant Examiner*—Henry E. Raduazo
*Attorney, Agent, or Firm*—Gifford, VanOphem, Sheridan & Sprinkle

[57] ABSTRACT

An improved anchor is provided for use with a mobile home having an underframe with an I-beam and wherein the mobile home is mounted above a base. The anchor comprises a pair of spaced clamping elements, each clamping element having an upper flange engaging portion for engaging the I-beam and a lower downwardly depending portion. One end of a chain is positioned between the downwardly depending portions of the clamping elements while a clevis is inserted through registering apertures in the downwardly depending portions and also through a link of the chain to thereby secure said end of the chain to the clamping elements. The other end of the chain is attached via a turnbuckle to the base.

7 Claims, 5 Drawing Figures

MOBILE HOME ANCHOR

BACKGROUND OF THE INVENTION

I. Field of the Invention

The present invention relates generally to hold down or anchoring devices and, more particularly, to such a device for use with a mobile home.

II. Description of the Prior Art

Due to their low cost, maximum land space utilization, and a plurality of other reasons, modular housing has become increasingly popular in our society. Such modular housing is commonly called a mobile home even though such homes are usually transported by a towing truck and semipermanently mounted upon a base at a chosen location. Such mobile homes are oftentimes never again transported except for their original installation.

Despite the relative permanence of a typical mobile home installation, the support for the home is oftentimes makeshift and inadequate. Moreover, since the weight of a typical mobile home is considerably less than that of a conventional dwelling, merely resting the mobile home on jacks or blocks, as is the usual case, does not produce the degree of support or stability to adequately insure against the mobile home shifting on its base due to normal vibration and/or wind forces.

In order to stabilize these previously known mobile homes there have been previously known anchoring devices engagable between an I-beam on the mobile home underframe and the base. One of these previously known anchoring devices is disclosed in U.S. Pat. No. 3,724,151 to Kaywood et al.

In the Kaywood et al mobile home anchor, a pair of spaced clamping elements engage the lower flange of an I-beam on the mobile home underframe. A tubular sleeve and bolt arrangement extends through registering apertures in the clamping elements and also through one link of a chain. The other end of the chain is connected via a turnbuckle through the mobile home support base.

A prime disadvantage of this previously known anchor, however, is the bolt and sleeve connection between the clamping elements at the upper end of the chain. More specifically, the multiplicity of the required assembly components, namely the bolt, sleeve, nut and conventional washers hinders the assembly of the mobile home anchor and makes the assembly both difficult and time consuming. The limited space between the underframe of the mobile home and its support base further increases the difficulty of assembly of this previously known mobile home anchor particularly since the installer must be able to reach and manipulate both ends of the bolt in order to tighten it.

A still further disadvantage of this previously known mobile home anchor is that after a period of time, the bolt, nut and tubular sleeve become rusted to each other which makes disassembly of the anchor, when desired, difficult if not altogether impossible. In these cases, it is usually necessary to saw through the anchor or otherwise destroy it in order to free the mobile home from the base. This, however, requires expensive replacement of the anchor upon the subsequent reinstallation of the mobile home.

SUMMARY OF THE PRESENT INVENTION

The present invention overcomes the above mentioned disadvantages of the previously known mobile home anchors by providing an improved anchor which can be easily and simply installed.

In brief, the anchor according to the present invention comprises a pair of spaced clamping elements. Each clamping element includes an upper flange engaging portion for engaging the lower flange of an I-beam on the mobile home underframe and a downwardly extending portion. When installed, the downwardly extending portions are spaced apart and substantially parallel to each other.

A clevis is insertable through registering apertures formed in the downwardly depending portions of the clamping elements and also through one link of one end of a chain positioned between the downwardly depending portions. The other end of the chain is connected to the base via a turnbuckle arrangement or by other suitable means.

The simple clevis thus effectively replaces the bolt, tubular sleeve and nut arrangement previously employed to secure the upper end of the chain to the clamping elements without sacrificing either strength or efficiency of the overall mobile home anchor. Moreover, the clevis can be easily inserted from one side only of the clamping elements and can be rapidly and simply freed from the clamping elements, when desired, despite rust.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 1:
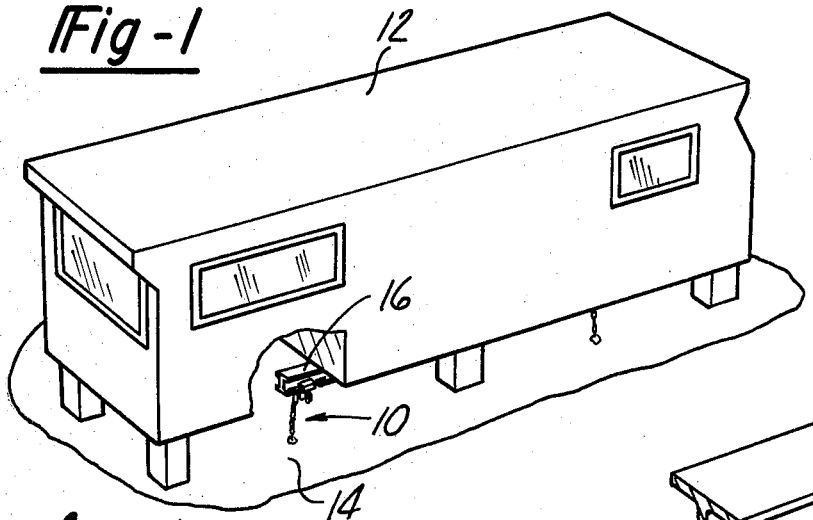
FIG. 1 is a perspective view of a typical mobile home installation using the anchor according to the present invention.
Figure 2:
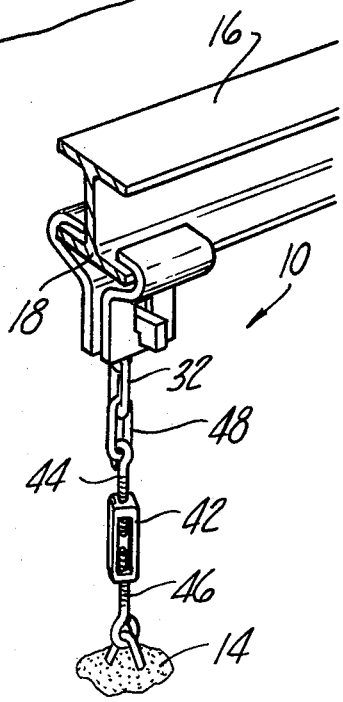
FIG. 2 is a fragmentary partial sectional view illustrating the anchor according to the present invention.

With reference first to FIGS. 1 and 2, a mobile home anchor 10 according to the present invention is thereshown anchoring a mobile home 12 to a suitable base 14. In the conventional fashion, the mobile home 12 includes an underframe with an I-beam 16 having a lower and substantially horizontal flange 18.

Figure 3:
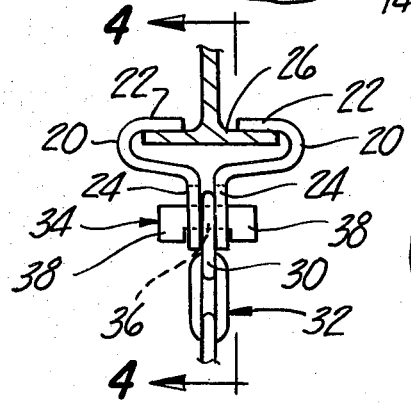
FIG. 3 is a fragmentary front plan view showing the upper portion of the anchor according to the present invention.
Figure 4:
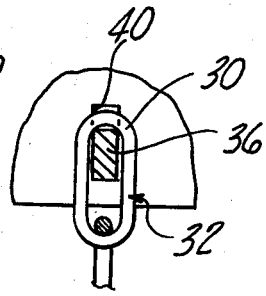
FIG. 4 is a fragmentary sectional view taken substantially along line 4—4 in FIG. 3 and enlarged for clarity.

With reference now to FIGS. 2–4, the anchor 10 of the present invention includes a pair of spaced and substantially identical clamping elements 20. Each clamping element includes an upper flange engaging portion 22 and a lower downwardly depending portion 24. The flange engaging portions 22 of the clamp elements 20 engage the upper surface 26 of the I-beam lower flange 18 such that the depending portions 24 extend vertically downwardly underneath the I-beam 16 and in a spaced and substantially parallel relationship to each other.

The downwardly depending portions 24 of the clamping elements 20 are connected to the upper link 30 of a chain 32 by means of a clevis 34 having a relatively long central leg 36 and a relatively short end leg 38 at each end thereat. The clevis is inserted lengthwise through registering apertures 40 formed through the downwardly depending portion 24 of each clamping element 20 and also through the upper link 30 of the chain 32 so that the relatively short end legs 38 of the clevis 34 are positioned on the outside of the downwardly depending portions 24. In this fashion, the clevis 34 simply but effectively secures the upper chain link 30 to the clamping elements 24 while the clevis end legs 38, upon downward movement, prevent unintended retraction of the clevis 34 from the apertures 40.

Preferably the depending portions 24 of each pair of clamping elements 20 are bent or angled towards each other near their lowermost portion so that the portions of the clamping elements 20 which surround the apertures 40 are substantially vertically parallel and are spaced apart from each other only a slight distance substantially equal to the width of the link 30 (see FIG. 3). Thus the link 30 is prevented from sliding laterally along the leg 36 of the clevis 34. In addition, the legs 36 and 38 of the clevis 34 are preferably separated from each other a distance substantially equal to the outer width of the pair of lowermost portions of the portions 24 having a link 30 inserted therebetween so that the inside surface of each leg 36 and 38 abuts against an outer surface of the clamping elements 20 to secure the link and clamping elements closely together.

With reference now to FIG. 2, a turnbuckle 42 of the type threadably engaging oppositely threaded eye bolts 44 and 46 is positioned underneath the clamping elements 20. The upper eye bolt 44 is suitably connected to the lower end 48 of the chain 32 while the lower eye bolt 46 is connected to the base 14 in any conventional fashion. With the mobile home anchor 10 according to the present invention secured onto the mobile home underframe I-beam 16 in the previously described fashion, rotation of the turnbuckle 42 tensions the chain 32 and effectively secures the mobile home underframe to the base 14.

Figure 5:
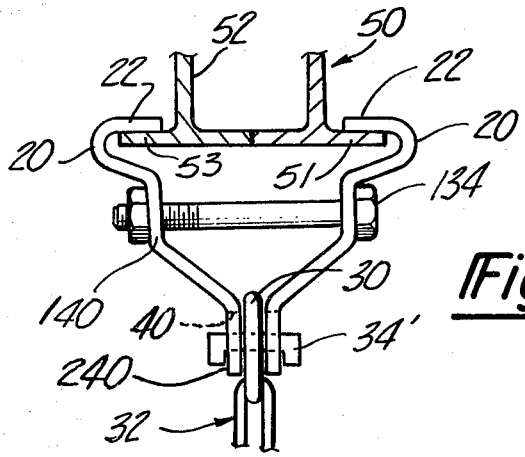
FIG. 5 is a fragmentary plan view similar to FIG. 3 but showing a modification thereof.

With reference to FIG. 5, a modification of the invention is thereshown for use with a double I-beam 50 and 52 on the underframe of the mobile home. The portion 22 of one clamping element 20 engages one-half of the lower flange 51 of the I-beam 50 while the portion 22 of the other clamping element 20 engages one-half of the lower flange 53 of the I-beam 52.

The clamping element 20 has a first substantially vertically depending portion 140 and a second substantially vertically depending portion 240. A registering aperture is provided in each portion 140 of a pair of clamping elements 20 so that a bolt 134 can be inserted therethrough and secured by a nut to urge the clamping elements into engagement with the lower flanges 51 and 53 of the I-beams. The second depending portions 240 of each of a pair of clamping elements 20 has a registering aperture 40 adapted to receive a clevis 34'. The portions of the clamping elements surrounding the registering apertures 40 are substantially vertically parallel and are spaced apart from each other only a slight distance substantially equal to the width of the link 30.

The clevis 34' is constructed and operates essentially the same as the clevis 34 shown in FIG. 3. Even though a bolt is used to secure the clamping elements 20 to the flanges 53 and 51, the mobile home 12 is easily separable from the base 14 since the clevis is easily removed from the apertures 40 to release the link 30 disposed between the portion 240. Consequently, even though rust accumulates on the bolt and clamping elements and prevents removal of the bolt 134, the anchor 10 is easily released.

From the foregoing it can be seen that the mobile home anchor 10 according to the present invention provides simple, inexpensive, easily installed and yet totally effective means for anchoring the mobile home 12 to its base 14. The present invention achieves this by means of the clevis 34 in lieu of the previously known bolt and sleeve construction. Moreover, due primarily to the minimum contact between the clevis 34 and the clamping elements 20, the clevis 34 can be removed from the clamping elements 20 when desired despite minor rust between the clevis 34 and the clamping elements 20.

Having described my invention, however, many modifications thereto will become apparent to those skilled in the art to which it pertains without deviation from the spirit of the invention as defined by the scope of the appended claims.

I claim:

1. In combination with a mobile home having an underframe with an I-beam and said mobile home being mounted above a base, an anchor for detachably securing said I-beam to said base comprising:

a pair of spaced clamping elements, each clamping element having an upper flange engaging portion and a downwardly depending portion, each downwardly depending portion having an aperture formed therethrough;

elongated connecting means extending from between the downwardly depending portions of the clamping elements and to said base, said connecting means having an aperture at its upper end;

means for securing the lower end of the connecting means to the base;

means for attaching the upper end of the connecting means to the clamping elements, said attaching means comprising a clevis having a central leg and two end legs, the central leg of said clevis being positioned through the apertures in said clamping elements and in the upper end of the connecting means so that the clevis and legs face downwardly and extend along the outside faces of the clamping element downwardly depending portions below said apertures; and means for tensioning said elongated connecting means to thereby hold said clevis to said clamping elements and so that said clevis prevents separation of said downwardly depending portions and thus separation of said clamping elements.

2. The invention as defined in claim 1 wherein said elongated connecting means comprises a chain and wherein said clevis is inserted through a link in said chain.

3. The invention as defined in claim 1 wherein said tensioning means comprises a turnbuckle which threadably engages one end of a first threaded member at one end of the turnbuckle and threadably engages one end of a second threaded member at the other end of the turnbuckle, the other end of the first threaded member being secured to the elongated connecting means and the other end of the second threaded member being secured to the base whereby rotation of the turnbuckle tensions the connecting means.

4. The invention as defined in claim 1 wherein the I-beam on the mobile underframe is a double I-beam.

5. The invention as defined in claim 1 wherein the clamping elements are substantially identical to each other.

6. The invention as defined in claim 1 wherein the central leg of the clevis is substantially longer than both end legs of the clevis.

7. The invention as defined in claim 1 wherein each said downwardly depending portion of said clamping element has a second aperture formed therethrough adapted to receive a bolt which together with a nut urges each said upper flange engaging portion of each pair of clamping elements into engagement with the flanges of said I-beam.

* * * * *